US010553221B2

(12) United States Patent
Tsukagoshi et al.

(10) Patent No.: US 10,553,221 B2
(45) Date of Patent: Feb. 4, 2020

(54) TRANSMITTING DEVICE, TRANSMITTING METHOD, RECEIVING DEVICE, AND RECEIVING METHOD FOR AUDIO STREAM INCLUDING CODED DATA

(71) Applicant: SONY CORPORATION, Tokyo (JP)

(72) Inventors: Ikuo Tsukagoshi, Tokyo (JP); Toru Chinen, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/327,187

(22) PCT Filed: Jun. 13, 2016

(86) PCT No.: PCT/JP2016/067596
§ 371 (c)(1),
(2) Date: Jan. 18, 2017

(87) PCT Pub. No.: WO2016/204125
PCT Pub. Date: Dec. 22, 2016

(65) Prior Publication Data

US 2017/0162206 A1 Jun. 8, 2017

(30) Foreign Application Priority Data

Jun. 17, 2015 (JP) ..... 2015-122292

(51) Int. Cl.
*G10L 19/00* (2013.01)
*G10L 19/008* (2013.01)
(Continued)

(52) U.S. Cl.
CPC ..... *G10L 19/008* (2013.01); *G10L 19/018* (2013.01); *G10L 19/167* (2013.01);
(Continued)

(58) Field of Classification Search
CPC ..... G10L 19/008; G10L 19/20; G10L 19/018
(Continued)

(56) References Cited

U.S. PATENT DOCUMENTS 6,169,973 B1 * 1/2001 Tsutsui ..... G11B 20/00007 704/500
6,778,966 B2 * 8/2004 Bizjak ..... H03G 3/3089 704/225
(Continued)

FOREIGN PATENT DOCUMENTS

JP 2009-151926 A 7/2009
JP 2011-528200 A 11/2011
(Continued)

OTHER PUBLICATIONS

International Search Report dated Jul. 12, 2016 in PCT/JP2016/067596 filed Jun. 13, 2016.
(Continued)

*Primary Examiner* — Edwin S Leland, III
(74) *Attorney, Agent, or Firm* — Oblon, McClelland, Maier & Neustadt, L.L.P.

(57) ABSTRACT

To suitably regulate sound pressure of object content on a receiving side.
An audio stream including coded data of a predetermined number of pieces of object content is generated. A container of a predetermined format including the audio stream is transmitted. Information indicating a range within which sound pressure is allowed to increase and decrease for each piece of object content is inserted into a layer of the audio stream and/or a layer of the container. On a receiving side, sound pressure of each piece of object content increases and decreases within the allowable range based on the information.

10 Claims, 21 Drawing Sheets

| | |
|---|---|
| num_of_content_groups (8bits) | INDICATE NUMBER OF CONTENT GROUPS |
| content_group_id (8bits) | INDICATE ID OF CONTENT GROUP |
| content_type (8bits) | INDICATE TYPE OF CONTENT GROUP |
| 0 | dialog language |
| 1 | sound effect |
| 2 | BGM |
| 3 | spoken subtitles |
| content_enhancement_plus_factor (8bits) | INDICATE UPPER LIMIT VALUE OF SOUND PRESSURE INCREASES AND DECREASE |
| Content_enhancement_minus_factor (8bits) | INDICATE LOWER LIMIT VALUE OF SOUND PRESSURE INCREASES AND DECREASE |

(51) Int. Cl.

| | |
|---|---|
| ***H04S 7/00*** | (2006.01) |
| ***H04S 5/02*** | (2006.01) |
| ***G10L 19/16*** | (2013.01) |
| ***G10L 19/018*** | (2013.01) |
| ***G10L 19/20*** | (2013.01) |

(52) U.S. Cl.
CPC ..... *G10L 19/20* (2013.01); *H04S 5/02* (2013.01); *H04S 7/00* (2013.01)

(58) Field of Classification Search
USPC ..... 704/500
See application file for complete search history.

(56) References Cited

U.S. PATENT DOCUMENTS 7,805,294 B2 * 9/2010 Taniguchi ..... G10L 25/78 375/303
8,195,318 B2 * 6/2012 Oh ..... G10L 19/008 381/17
9,933,989 B2 * 4/2018 Tsingos ..... H04S 7/304
2007/0225840 A1 * 9/2007 Yahata ..... G11B 20/00007 700/94
2010/0014692 A1 * 1/2010 Schreiner ..... H04S 3/008 381/119
2013/0108079 A1 * 5/2013 Sato ..... G10L 19/008 381/107
2013/0231940 A1 * 9/2013 Ehara ..... G10L 19/005 704/500
2013/0308800 A1 * 11/2013 Bacon ..... F25D 23/063 381/300
2014/0119581 A1 * 5/2014 Tsingos ..... H04S 3/008 381/300
2014/0201069 A1 * 7/2014 Arentz ..... H04B 11/00 705/39
2014/0282706 A1 * 9/2014 Kim ..... H04N 13/161 725/33
2014/0297291 A1 10/2014 Baumgarte
2014/0350944 A1 * 11/2014 Jot ..... G10L 19/008 704/500
2015/0248888 A1 * 9/2015 Wong ..... H03G 3/10 704/500
2015/0254054 A1 * 9/2015 Sun ..... G05B 15/02 700/94
2015/0371644 A1 * 12/2015 Par ..... G10L 19/008 381/23
2016/0014540 A1 * 1/2016 Kelly ..... H04R 1/403 381/303
2016/0211817 A1 * 7/2016 Krishnaswamy ..... H03G 3/02
2017/0032793 A1 * 2/2017 Baumgarte ..... H04S 3/008
2017/0162206 A1 * 6/2017 Tsukagoshi ..... G10L 19/008
2017/0223429 A1 * 8/2017 Schreiner ..... G10L 19/00
2017/0243596 A1 * 8/2017 Eggerding ..... G10L 19/008
2018/0152803 A1 * 5/2018 Seefeldt ..... H04S 7/30
2018/0242042 A1 * 8/2018 Wang ..... H04N 21/454
2019/0130922 A1 * 5/2019 Tsukagoshi ..... G10L 19/008

FOREIGN PATENT DOCUMENTS

JP 2014-520491 A 8/2014
JP 2014-525048 A 9/2014
WO WO 2008/060111 A1 5/2008
WO WO 2010/087631 A2 8/2010
WO WO-2010087631 A2 * 8/2010 ..... G10L 19/008

OTHER PUBLICATIONS

Extended European Search Report dated Nov. 15, 2018, in Patent Application No. 16811599.6.
"Information technology—High efficiency coding and media delivery in heterogeneous environments—Part 3: 3D audio" ISO/IEC JTC 1/SC 29, Jul. 25, 2014, 433 pages.
AX Jürgen Herre, et al., "MPEG-H Audio—The New Standard for Universal Spatial / 3D Audio Coding" Audio Engineering Society Convention, vol. 137, 2014, pp. 1-12.

* cited by examiner

FIG. 4

| usacExtElementType | Value |
|---|---|
| ID_EXT_ELE_FILL | 0 |
| ID_EXT_ELE_MPEGS | 1 |
| ID_EXT_ELE_SAOC | 2 |
| ID_EXT_ELE_AUDIOPREROLL | 3 |
| ID_EXT_ELE_UNI_DRC | 4 |
| ID_EXT_ELE_OBJ_METADATA | 5 |
| ID_EXT_ELE_SAOC_3D | 6 |
| ID_EXT_ELE_HOA | 7 |
| /* reserved for ISO use */ | 8-127 |
| /* reserved for use outside of ISO scope */ | 128 and higher |
| ID_EXT_ELE_content_enhancement | 128 |

FIG. 5

Content_Enhancement _frame syntax

| Syntax | No. of Bits | Format |
|---|---|---|
| Content_Enhancement_frame() { | | |
| packet_length | 8 | uimsbf |
| num_of_content_groups | 8 | uimsbf |
| for (i = 0; i < num_of_object_groups; i++) { | | |
| content_group_id | 8 | uimsbf |
| content_type | 8 | uimsbf |
| content_enhancement_plus_factor | 8 | uimsbf |
| content_enhancement_minus_factor | 8 | uimsbf |
| } | | |
| } | | |

FIG. 6

| | | |
|---|---|---|
| num_of_content_groups (8bits) | | INDICATE NUMBER OF CONTENT GROUPS |
| content_group_id (8bits) | | INDICATE ID OF CONTENT GROUP |
| content_type (8bits) | | INDICATE TYPE OF CONTENT GROUP |
| 0 | dialog language | |
| 1 | sound effect | |
| 2 | BGM | |
| 3 | spoken subtitles | |
| content_enhancement_plus_factor (8bits) | | INDICATE UPPER LIMIT VALUE OF SOUND PRESSURE INCREASES AND DECREASE |
| Content_enhancement_minus_factor (8bits) | | INDICATE LOWER LIMIT VALUE OF SOUND PRESSURE INCREASES AND DECREASE |

FIG. 7

(EXAMPLE OF Factor VALUE)

content_enhancement_plus_factor (8bits)

| | |
|---|---|
| 0x00 | 1 (0dB) |
| 0x01 | 1.4 (+3dB) |
| 0x02 | 1.9 (+6dB) |
| 0x03 | 2.8 (+9dB) |
| 0x04 | 3.9 (+12dB) |
| : | |
| 0xFF | +infinite (+infinite dB) |

content_enhancement_minus_factor (8bits)

| | |
|---|---|
| 0x00 | 1 (0dB) |
| 0x01 | 0.7 (-3dB) |
| 0x02 | 0.5 (-6dB) |
| 0x03 | 0.35 (-9dB) |
| 0x04 | 0.25 (-12dB) |
| : | |
| 0xFF | 0.00 (-infinite dB) |

FIG. 8

Audio Content Enhancement descriptor

| Syntax | No. of Bits | Format |
|---|---|---|
| Audio_Content_Enhancement_descriptor ( ) { | | |
| descriptor_tag | 8 | uimsbf |
| descriptor_length | 8 | uimsbf |
| num_of_content_groups | 8 | uimsbf |
| for (i = 0; i < num_of_object_groups; i++) { | | |
| content_group_id | 8 | uimsbf |
| content_type | 8 | uimsbf |
| content_enhancement_plus_factor | 8 | uimsbf |
| content_enhancement_minus_factor | 8 | uimsbf |
| } | | |
| } | | |

TS STRUCTURE

FIG. 16

(EXAMPLE OF Factor VALUE)

| | | |
|---|---|---|
| content_enhancement_plus_factor_1 (8bits) | | |
| | 0x00 | 1 (0dB) |
| | 0x01 | 1.4 (+3dB) |
| | 0x02 | 1.9 (+6dB) |
| | 0x03 | 2.8 (+9dB) |
| | 0x04 | 3.9 (+12dB) |
| | : | |
| | 0xFF | +infinite (+infinite dB) |
| content_enhancement_minus_factor_1 (8bits) | | |
| | 0x00 | 1 (0dB) |
| | 0x01 | 0.7 (-3dB) |
| | 0x02 | 0.5 (-6dB) |
| | 0x03 | 0.35 (-9dB) |
| | 0x04 | 0.25 (-12dB) |
| | : | |
| | 0xFF | 0.00 (-infinite dB) |
| content_enhancement_plus_factor_2 (8bits) | | |
| | 0x00 | 1 (0dB) |
| | 0x01 | 1.9 (+6dB) |
| | 0x02 | 3.9 (+12dB) |
| | : | |
| | 0x7F | +infinite (+infinite dB) |
| content_enhancement_minus_factor_2 (8bits) | | |
| | 0x00 | 1 (0dB) |
| | 0x01 | 0.5 (-6dB) |
| | 0x02 | 0.25 (-12dB) |
| | : | |
| | 0x7F | 0.00 (-infinite dB) |

FIG. 17

Content_Enhancement _frame syntax

| Syntax | No. of Bits | Format |
|---|---|---|
| Content_Enhancement_frame() { | | |
| packet_length | 8 | uimsbf |
| num_of_content_groups | 8 | uimsbf |
| for (i = 0; i < num_of_object_groups; i++) { | | |
| content_group_id | 8 | uimsbf |
| content_type | 8 | uimsbf |
| factor_type | 8 | uimsbf |
| content_enhancement_plus_factor | 8 | uimsbf |
| content_enhancement_minus_factor | 8 | uimsbf |
| } | | |
| } | | |

FIG. 18

| | | |
|---|---|---|
| num_of_content_groups (8bits) | | INDICATE NUMBER OF CONTENT GROUPS |
| content_group_id (8bits) | | INDICATE ID OF CONTENT GROUP |
| content_type (8bits) | | INDICATE TYPE OF CONTENT GROUP |
| | 0 | dialog language |
| | 1 | sound effect |
| | 2 | BGM |
| | 3 | spoken subtitles |
| factor_type(8bits) | | INDICATE TYPE OF APPLICATION FACTOR |
| | 0 | factor_1 |
| | 1 | factor_2 |
| content_enhancement_plus_factor (8bits) | | INDICATE UPPER LIMIT VALUE OF SOUND PRESSURE INCREASES AND DECREASE |
| Content_enhancement_minus_factor (8bits) | | INDICATE LOWER LIMIT VALUE OF SOUND PRESSURE INCREASES AND DECREASE |

FIG. 19

Audio Content Enhancement descriptor

| Syntax | No. of Bits | Format |
|---|---|---|
| Audio_Content_Enhancement_descriptor ( ) { | | |
| descriptor_tag | 8 | uimsbf |
| descriptor_length | 8 | uimsbf |
| num_of_content_groups | 8 | uimsbf |
| for (i = 0; i < num_of_object_groups; i++) { | | |
| content_group_id | 8 | uimsbf |
| content_type | 8 | uimsbf |
| factor_type | 8 | uimsbf |
| content_enhancement_plus_factor | 8 | uimsbf |
| content_enhancement_minus_factor | 8 | uimsbf |
| } | | |
| } | | |

MMT STRUCTURE

TRANSMITTING DEVICE, TRANSMITTING METHOD, RECEIVING DEVICE, AND RECEIVING METHOD FOR AUDIO STREAM INCLUDING CODED DATA

TECHNICAL FIELD

The present technology relates to a transmitting device, a transmitting method, a receiving device, and a receiving method, and specifically, to a transmitting device configured to transmit an audio stream including coded data of a predetermined number of pieces of object content.

BACKGROUND ART

In recent years, as a three-dimensional (3D) sound technology, a technology for mapping and rendering coded sample data to a speaker that is in any position based on metadata has been proposed (for example, refer to Patent Literature 1).

CITATION LIST

Patent Literature

Patent Literature 1 JP 2014-520491T

DISCLOSURE OF INVENTION

Technical Problem

Transmitting coded data of various types of object content including coded sample data and metadata together with channel coded data such as 5.1 channel and 7.1 channel to enable highly realistic sound reproduction on a receiving side is considered. For example, object content such as a dialog language is difficult to hear according to a background sound and a viewing environment in some cases.

An object of the present technology is to suitably regulate sound pressure of object content on a receiving side.

Solution to Problem

A concept of the present technology is a transmitting device including: an audio encoding unit configured to generate an audio stream including coded data of a predetermined number of pieces of object content; a transmitting unit configured to transmit a container of a predetermined format including the audio stream; and an information inserting unit configured to insert information indicating a range within which sound pressure is allowed to increase and decrease for each piece of object content into a layer of the audio stream and/or a layer of the container.

In the present technology, an audio encoding unit generates an audio stream including coded data of a predetermined number of pieces of object content. The information inserting unit inserts the information indicating a range within which sound pressure is allowed to increase and decrease for each piece of object content into a layer of the audio stream and/or a layer of the container.

For example, the information indicating a range within which sound pressure is allowed to increase and decrease for each piece of object content is information about an upper limit value and lower limit value of sound pressure. In addition, for example, a coding scheme of the audio stream is MPEG-H 3D Audio. The information inserting unit may include an extension element including the information indicating a range within which sound pressure is allowed to increase and decrease for each piece of object content in an audio frame.

In this manner, in the present technology, the information indicating a range within which sound pressure is allowed to increase and decrease for each piece of object content is inserted into a layer of the audio stream and/or a layer of the container. Therefore, when the inserted information is used on a receiving side, it is easy to regulate an increase and decrease of sound pressure of each piece of object content within the allowable range.

In the present technology, for example, each of the predetermined number of pieces of object content may belong to any of a predetermined number of content groups, and the information inserting unit may insert information indicating a range within which sound pressure is allowed to increase and decrease for each content group into a layer of the audio stream and/or a layer of the container. In this case, information indicating a range within which sound pressure is allowed to increase and decrease is sent to correspond to the number of content groups and the information indicating a range within which sound pressure is allowed to increase and decrease for each piece of object content can be efficiently transmitted.

In the present technology, for example, factor type information indicating a type to be applied among a plurality of factor types may be added to the information indicating a range within which sound pressure is allowed to increase and decrease for each piece of object content. In this case, it is possible to apply a factor type appropriate for each piece of object content.

Another concept of the present technology is a receiving device including: a receiving unit configured to receive a container of a predetermined format including an audio stream including coded data of a predetermined number of pieces of object content; and a control unit configured to control a process of increasing and decreasing sound pressure in which sound pressure of object content increases and decreases according to user selection.

In the present technology, a receiving unit receives a container of a predetermined format including an audio stream including coded data of a predetermined number of pieces of object content. A control unit controls a processing of increasing and decreasing sound pressure in which sound pressure of object content increases and decreases according to user selection.

In this manner, in the present technology, a process of increasing and decreasing sound pressure of object content according to the user selection is performed. Accordingly, sound pressure of a predetermined number of pieces of object content can be effectively regulated, for example, sound pressure of predetermined object content can increase and sound pressure of another piece of object can decrease.

In the present technology, for example, information indicating a range within which sound pressure is allowed to increase and decrease for each piece of object content is inserted may be inserted into a layer of the audio stream and/or a layer of the container, the control unit may further control an information extracting process in which the information indicating a range within which sound pressure is allowed to increase and decrease for each piece of object content is extracted from the layer of the audio stream and/or the layer of the container, and in the process of increasing and decreasing sound pressure, sound pressure of object content may increase and decrease according to user selection based on the extracted information. In this case, it is easy to regulate sound pressure of each piece of object content within an allowable range.

In the present technology, for example, in the process of increasing and decreasing sound pressure, when sound pressure of the object content increases according to the user selection, sound pressure of another piece of object content may decrease, and when sound pressure of the object content decreases according to the user selection, sound pressure of another piece of object content may increase. In this case, without requiring manipulation time and effort of the user, it is possible to maintain constant sound pressure in all of the object content.

In the present technology, for example, the control unit may further control a display process in which a user interface screen indicating a sound pressure state of object content whose sound pressure increases and decreases in the process of increasing and decreasing sound pressure is displayed. In this case, the user can easily recognize a sound pressure state of each piece of object content and easily set sound pressure.

Advantageous Effects of Invention

According to the present technology, sound pressure of object content may be suitably regulated on a receiving side. The effects described herein are only examples and the present technology is not limited thereto. Additional effects may be provided.

BRIEF DESCRIPTION OF DRAWINGS

FIG. 4 is a diagram showing a correspondence relation between a type of an extension element (ExElementType) and a value (Value) thereof.

FIG. 5 is a diagram showing a structural example of a content enhancement frame including information indicating a range within which sound pressure is allowed to increase and decrease for each content group as an extension element.

FIG. 6 is a diagram showing content of main information in a structural example of a content enhancement frame.

FIG. 7 is a diagram showing an example of a value (a factor value) of sound pressure represented by information indicating a range within which sound pressure is allowed to increase and decrease.

FIG. 8 is a diagram showing a structural example of an audio content enhancement descriptor.

FIG. 16 is a diagram showing another example of a value (a factor value) of sound pressure represented by information indicating a range within which sound pressure is allowed to increase and decrease.

FIG. 17 is a diagram showing another structural example of a content enhancement frame including information indicating a range within which sound pressure is allowed to increase and decrease for each content group as an extension element.

FIG. 18 is a diagram showing content of main information in a structural example of a content enhancement frame.

FIG. 19 is a diagram showing another structural example of the audio content enhancement descriptor.

MODE(S) FOR CARRYING OUT THE INVENTION

Hereinafter, forms (hereinafter referred to as "embodiments") for implementing the present technology will be described. The description will proceed in the following order.

1. Embodiment
2. Modified example

1. Embodiment

[Configuration Example of Transmitting and Receiving System]

Figure 1:
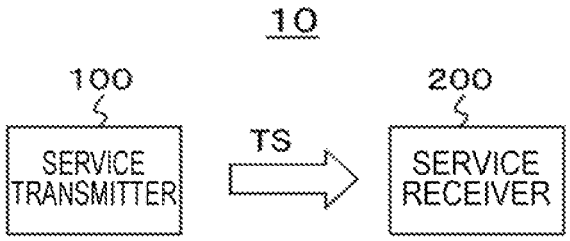
FIG. 1 is a block diagram showing a configuration example of a transmitting and receiving system as an embodiment.

FIG. 1 shows a configuration example of a transmitting and receiving system 10 as an embodiment. The transmitting and receiving system 10 includes a service transmitter 100 and a service receiver 200. The service transmitter 100 transmits a transport stream TS through broadcast waves or packets via a network.

The transport stream TS includes an audio stream or a video stream and an audio stream. The audio stream includes channel coded data and coded data of a predetermined number of pieces of object content (object coded data). In this embodiment, a coding scheme of the audio stream is MPEG-H 3D Audio.

The service transmitter 100 inserts information indicating a range within which sound pressure is allowed to increase and decrease (upper limit value and lower limit value information) for each piece of object content into a layer of the audio stream and/or a layer of the transport stream TS as a container. For example, each of the predetermined number of pieces of object content belongs to any of a predetermined number of content groups. The service transmitter 200 inserts information indicating a range within which sound pressure is allowed to increase and decrease for each content group into a layer of the audio stream and/or a layer of the container.

Figure 2:
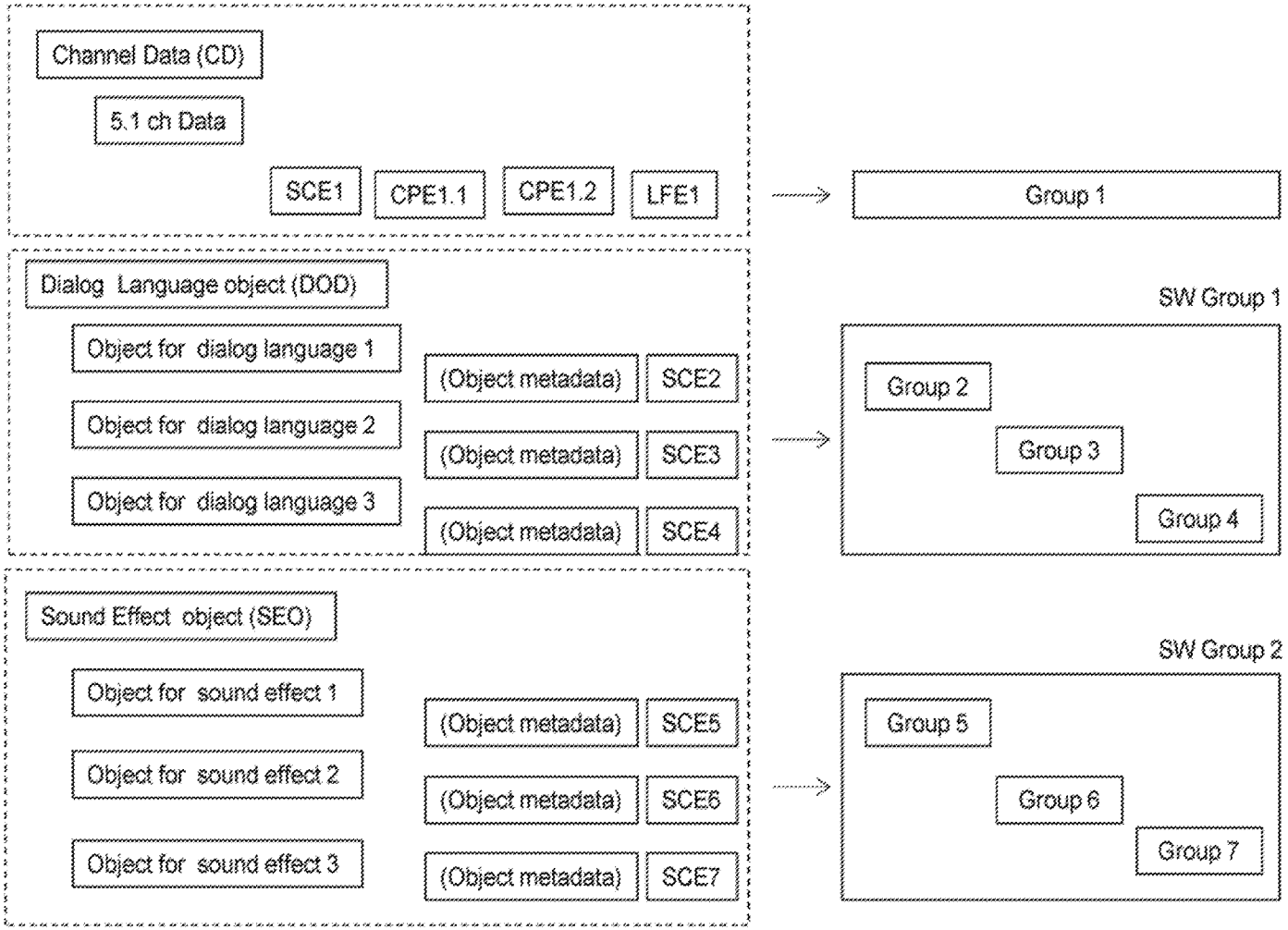
FIG. 2 is a diagram showing a configuration example of transport data of MPEG-H 3D Audio.

FIG. 2 shows a configuration example of transport data of MPEG-H 3D Audio. The configuration example includes one piece of channel coded data and six pieces of object coded data. One piece of channel coded data is channel coded data (CD) of 5.1 channel, and includes each piece of coded sample data of SCE1, CPE1.1, CPE1.2 and LFE1.

Among the six pieces of object coded data, first three pieces of object coded data belong to coded data (DOD) of a content group of a dialog language object. The three pieces of object coded data are coded data of dialog language object (Object for dialog language) corresponding to first, second, and third languages.

The coded data of the dialog language object corresponding to the first, second, and third languages includes coded sample data SCE2, SCE3, and SCE4 and metadata (Object metadata) for mapping and rendering the coded sample data to a speaker that is in any position.

In addition, among the six pieces of object coded data, the remaining three pieces of object coded data belong to coded data (SEO) of a content group of a sound effect object. The three pieces of object coded data are coded data of a sound effect object (Object for sound effect) corresponding to first, second, and third sound effects.

The coded data of the sound effect object corresponding to the first, second, and third sound effects includes coded sample data SCE5, SCE6, and SCE7 and metadata (Object metadata) for mapping and rendering the coded sample data to a speaker that is in any position.

The coded data is classified by a concept of a group (Group) for each category. In this configuration example, channel coded data of 5.1 channel is classified as a group 1 (Group 1). In addition, coded data of the dialog language object corresponding to the first, second, and third languages is classified as a group 2 (Group 2), a group 3 (Group 3), and a group 4 (Group 4), respectively. In addition, coded data of the sound effect object corresponding to the first, second, and third sound effects is classified as a group 5 (Group 5), a group 6 (Group 6), and a group 7 (Group 7), respectively.

In addition, data that can be selected among groups on a receiving side is registered in a switch group (SW Group) and coded. In this configuration example, a group 2, a group 3, and a group 4 belonging to a content group of the dialog language object are classified as a switch group 1 (SW Group 1). In addition, a group 5, a group 6, and a group 7 belonging to a content group of the sound effect object are classified as a switch group 2 (SW Group 2).

Figure 3:
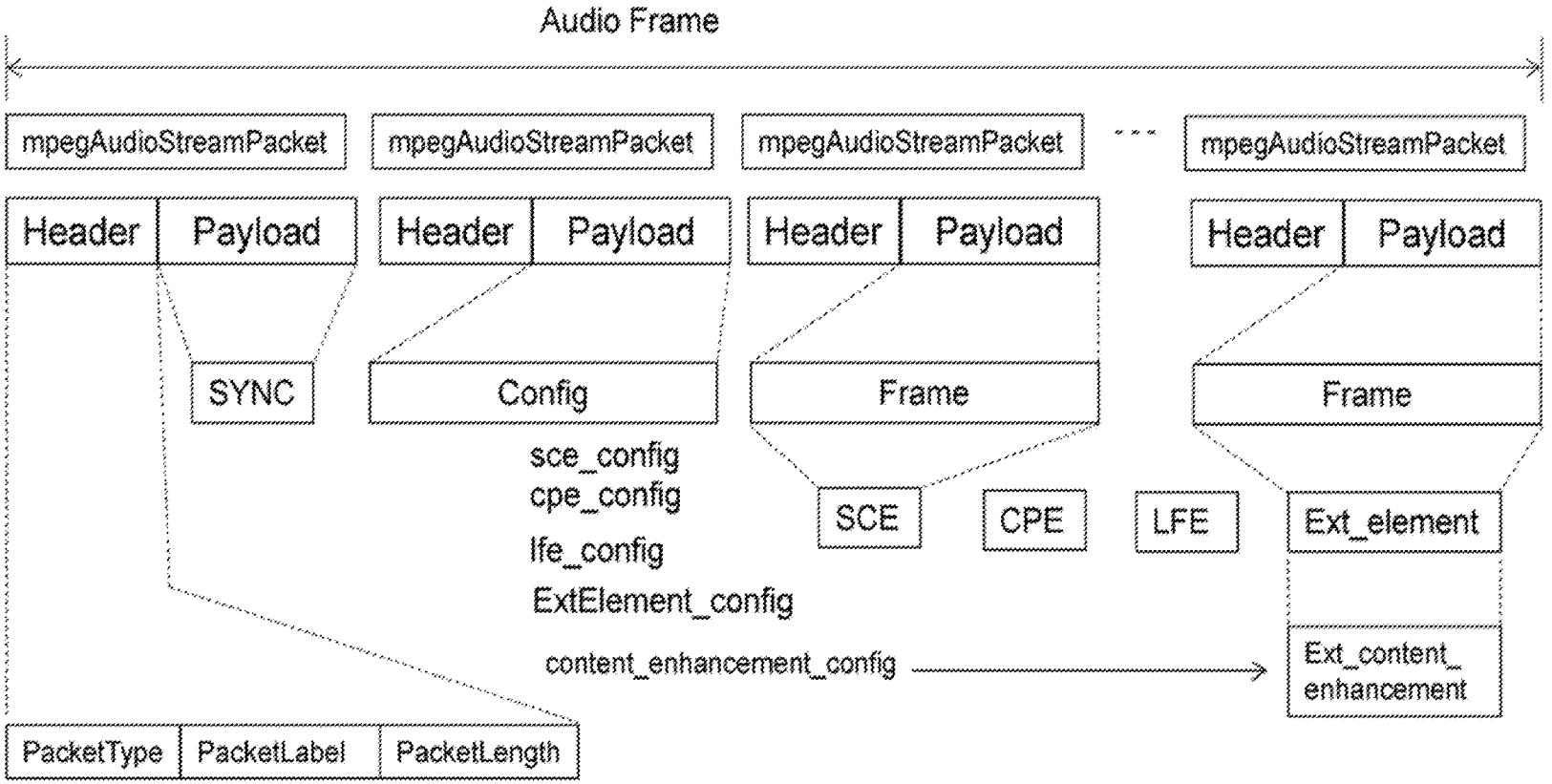
FIG. 3 is a diagram showing a structural example of an audio frame in transport data of MPEG-H 3D Audio.

FIG. 3 shows a structural example of an audio frame in transport data of MPEG-H 3D Audio. The audio frame includes a plurality of MPEG audio stream packets (mpeg Audio Stream Packets). Each of the MPEG audio stream packets includes a header (Header) and a payload (Payload).

The header includes information such as a packet type (Packet Type), a packet label (Packet Label), and a packet length (Packet Length). Information defined in the packet type of the header is assigned in the payload. The payload information includes "SYNC" corresponding to a synchronization start code, "Frame" serving as actual data of 3D audio transport data and "Config" indicating a configuration of the "Frame."

The "Frame" includes channel coded data and object coded data constituting 3D audio transport data. Here, the channel coded data includes coded sample data such as a Single Channel Element (SCE), a Channel Pair Element (CPE), and a Low Frequency Element (LFE). In addition, the object coded data includes the coded sample data of the Single Channel Element (SCE) and metadata for mapping and rendering the coded sample data to a speaker that is in any position. The metadata is included as an extension element (Ext_element).

In the embodiment, as the extension element (Ext_element), an element (Ext_content_enhancement) including information indicating a range within which sound pressure is allowed to increase and decrease for each content group is newly defined. Accordingly, a configuration information (content_enhancement config) of the element is newly defined in "Config."

FIG. 4 shows a correspondence relation between a type (ExElementType) of the extension element (Ext_element) and a value thereof (Value). For example, 128 is newly defined as a value of a type of "ID_EXT_ELE_content_enhancement."

FIG. 5 shows a structural example (syntax) of a content enhancement frame (Content_Enhancement_frame( )) including information indicating a range within which sound pressure is allowed to increase and decrease for each content group as an extension element. FIG. 6 shows content (semantics) of main information in this configuration example.

An 8-bit field of "num_of_content_groups" indicates the number of content groups. An 8-bit field of "content_group_id," an 8-bit field of "content_type," an 8-bit field of "content_enhancement_plus_factor," and an 8-bit field of "content_enhancement_minus_factor" are repeatedly provided to correspond to the number of content groups.

The field of "content_group_id" indicates an identifier (ID) of the content group. The field of "content_type" indicates a type of the content group. For example, "0" indicates a "dialog language," "1" indicates a "sound effect," "2" indicates "BGM," and "3" indicates "spoken subtitles."

The field of "content_enhancement_plus_factor" indicates an upper limit value of sound pressure increase and decrease. For example, as shown in the table of FIG. 7, "0x00" indicates 1 (0 dB), "0x01" indicates 1.4 (+3 dB), and "0xFF" indicates infinite (+infinit dB). The field of "content_enhancement_minus_factor" indicates a lower limit value of sound pressure increase and decrease. For example, as shown in the table of FIG. 7, "0x00" indicates 1 (0 dB), "0x01" indicates 0.7 (−3 dB), and "0xFF" indicates 0.00 (−infinit dB). The table of FIG. 7 is shared in the service receiver 200.

In addition, in the embodiment, an audio content enhancement descriptor (Audio_Content_Enhancement descriptor) including information indicating a range within which sound pressure is allowed to increase and decrease for each content group is newly defined. Therefore, the descriptor is inserted into an audio elementary stream loop that is provided under a program map table (PMT).

FIG. 8 shows a structural example (Syntax) of an audio content enhancement descriptor. An 8-bit field of "descriptor_tag" indicates a descriptor type and indicates an audio content enhancement descriptor here. An 8-bit field of "descriptor_length" indicates a length (a size) of a descriptor and the length of the descriptor indicates the following number of bytes.

An 8-bit field of "num_of_content_groups" indicates the number of content groups. An 8-bit field of "content_group_id," an 8-bit field of "content_type," an 8-bit field of "content_enhancement_plus_factor," and an 8-bit field of "content_enhancement_minus_factor" are repeatedly provided to correspond to the number of content groups. Content of information of the fields is similar to that described in the above-described content enhancement frame (refer to FIG. 5).

Referring again to FIG. 1, the service receiver 200 receives broadcast waves or the transport stream TS transmitted through packets via a network from the service transmitter 100. The transport stream TS includes an audio stream in addition to a video stream. The audio stream includes channel coded data of 3D audio transport data and coded data of a predetermined number of pieces of object content (object coded data).

Information indicating a range within which sound pressure is allowed to increase and decrease for each piece of object content is inserted into a layer of the audio stream and/or a layer of the transport stream TS as a container. For example, information indicating a range within which sound pressure is allowed to increase and decrease for a predetermined number of content groups is inserted. Here, one or a plurality of pieces of object content belong to one content group.

The service receiver 200 performs decoding processing on the video stream and obtains video data. In addition, the service receiver 200 performs decoding processing on the audio stream and obtains audio data of 3D audio.

The service receiver 200 performs a process of increasing and decreasing sound pressure on object content according to user selection. In this case, the service receiver 200 limits a range of sound pressure increase and decrease based on a range within which sound pressure is allowed to increase and decrease for each piece of object content that is inserted into a layer of the audio stream and/or a layer of the transport stream TS as a container.

[Stream Generating Unit of Service Transmitter]

Figure 9:
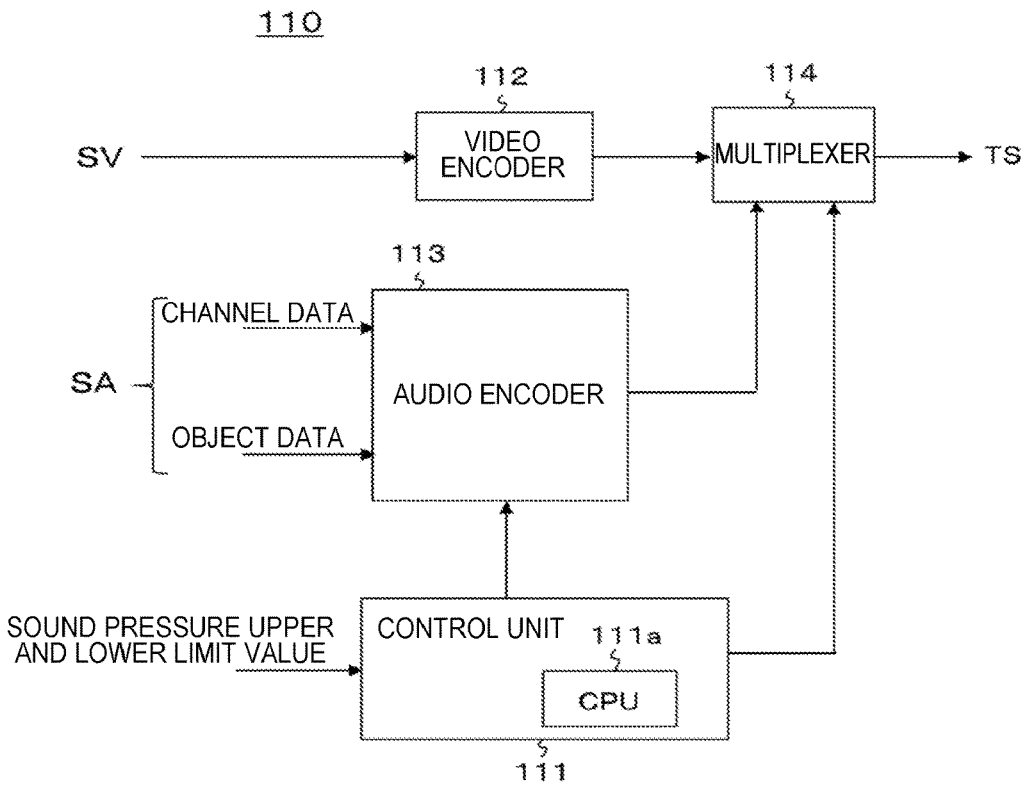
FIG. 9 is a block diagram showing a configuration example of a stream generating unit of a service transmitter.

FIG. 9 shows a configuration example of a stream generating unit 110 of the service transmitter 100. The stream generating unit 110 includes a control unit 111, a video encoder 112, an audio encoder 113, and a multiplexer 114.

The video encoder 112 inputs video data SV, codes the video data SV, and generates a video stream (a video elementary stream). The audio encoder 113 inputs object data of a predetermined number of content groups in addition to channel data as audio data SA. One or a plurality of pieces of object content belong to each content group.

The audio encoder 113 codes the audio data SA, obtains 3D audio transport data, and generates an audio stream (an audio elementary stream) including the 3D audio transport data. The 3D audio transport data includes object coded data of a predetermined number of content groups in addition to channel coded data.

For example, as shown in the configuration example of FIG. 2, channel coded data (CD), coded data (DOD) of a content group of a dialog language object, and coded data (SEO) of a content group of a sound effect object are included.

The audio encoder 113 inserts information indicating a range within which sound pressure is allowed to increase and decrease for each content group into the audio stream under control of the control unit 111. In the embodiment, a newly defined element (Ext_content_enhancement) including information indicating a range within which sound pressure is allowed to increase and decrease for each content group is inserted into the audio frame as an extension element (Ext_element) (refer to FIG. 3 and FIG. 5).

The multiplexer 114 PES-packetizes the video stream output from the video encoder 112 and a predetermined number of audio streams output from the audio encoder 113, additionally transport-packetizes and multiplexes the stream, and obtains a transport stream TS as the multiplexed stream.

The multiplexer 114 inserts information indicating a range within which sound pressure is allowed to increase and decrease for each content group into the transport stream TS as a container under control of the control unit 111. In the embodiment, a newly defined audio content enhancement descriptor including information indicating a range within which sound pressure is allowed to increase and decrease for each content group (Audio_Content_Enhancement descriptor) is inserted into the audio elementary stream loop that is provided under the PMT (refer to FIG. 8).

Operations of the stream generating unit 110 shown in FIG. 9 will be briefly described. The video data is supplied to the video encoder 112. In the video encoder 112, the video data SV is coded and a video stream including the coded video data is generated. The video stream is supplied to the multiplexer 114.

The audio data SA is supplied to the audio encoder 113. The audio data SA includes object data of a predetermined number of content groups in addition to channel data. Here, one or a plurality of pieces of object content belong to each content group.

In the audio encoder 113, the audio data SA is coded and therefore 3D audio transport data is obtained. The 3D audio transport data includes object coded data of a predetermined number of content groups in addition to channel coded data. Therefore, in the audio encoder 113, an audio stream including the 3D audio transport data is generated.

In this case, in the audio encoder 113, information indicating a range within which sound pressure is allowed to increase and decrease for each content group is inserted into the audio stream under control of the control unit 111. That is, a newly defined element (Ext_content_enhancement) including information indicating a range within which sound pressure is allowed to increase and decrease for each content group is inserted into the audio frame as an extension element (Ext_element) (refer to FIG. 3 and FIG. 5).

The video stream generated in the video encoder 112 is supplied to the multiplexer 114. In addition, the audio stream generated in the audio encoder 113 is supplied to the multiplexer 114. In the multiplexer 114, a stream supplied from each encoder is PES-packetized and is additionally transport-packetized and multiplexed, and a transport stream TS as the multiplexed stream is obtained.

In this case, in the multiplexer 114, information indicating a range within which sound pressure is allowed to increase and decrease for each content group is inserted into the transport stream TS as a container under control of the control unit 111. That is, a newly defined audio content enhancement descriptor (Audio_Content_Enhancement descriptor) including information indicating a range within which sound pressure is allowed to increase and decrease for each content group is inserted into the audio elementary stream loop that is provided under the PMT (refer to FIG. 8).

[Configuration of Transport Stream TS]

Figure 10:
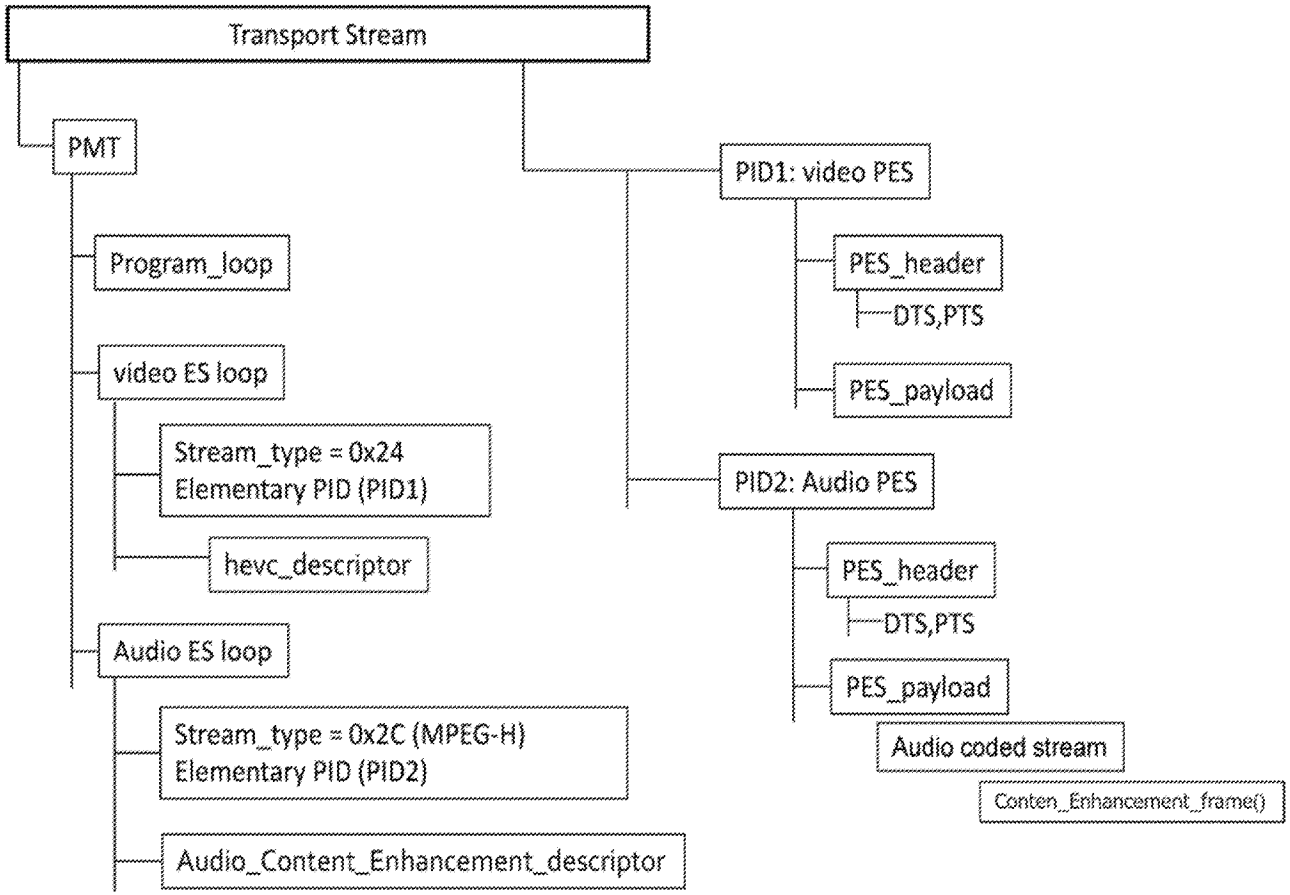
FIG. 10 is a diagram showing a structural example of a transport stream TS.

FIG. 10 shows a structural example of the transport stream TS. The structural example includes a PES packet "video PES" of a video stream that is identified as a PID1 and a PES packet "audio PES" of an audio stream that is identified as a PID2. The PES packet includes a PES header (PES_header) and a PES payload (PES_payload). Timestamps of DTS and PTS are inserted into the PES header.

An audio stream (Audio coded stream) is inserted into the PES payload of the PES packet of the audio stream. A content enhancement frame (Content_Enhancement_frame( )) including information indicating a range within which sound pressure is allowed to increase and decrease for each content group is inserted into an audio frame of the audio stream.

In addition, in the transport stream TS, a program map table (PMT) is included as program specific information (PSI). The PSI is information that describes a program to which each elementary stream included in a transport stream belongs. The PMT includes a program loop (Program loop) that describes information associated with the entire program.

In addition, the PMT includes an elementary stream loop including information associated with each elementary stream. The configuration example includes a video elementary stream loop (video ES loop) corresponding to a video stream and an audio elementary stream loop (audio ES loop) corresponding to an audio stream.

In the video elementary stream loop (video ES loop), information such as a stream type and a packet identifier (PID) corresponding to a video stream is assigned and a descriptor that describes information associated with the video stream is also assigned. A value of "Stream_type" of the video stream is set to "0x24," and PID information indicates a PID1 that is assigned to a PES packet "video PES" of the video stream as described above. As one descriptor, an HEVC descriptor is assigned.

In addition, in the audio elementary stream loop (audio ES loop), information such as a stream type and a packet identifier (PID) corresponding to an audio stream is assigned and a descriptor that describes information associated with the audio stream is also assigned. A value of "Stream_type" of the audio stream is set to "0x2C" and PID information indicates a PID2 that is assigned to a PES packet "audio PES" of the audio stream as described above. As one descriptor, an audio content enhancement descriptor (Audio_Content_Enhancement descriptor) including information indicating a range within which sound pressure is allowed to increase and decrease for each content group is assigned.

[Configuration Example of Service Receiver]

Figure 11:
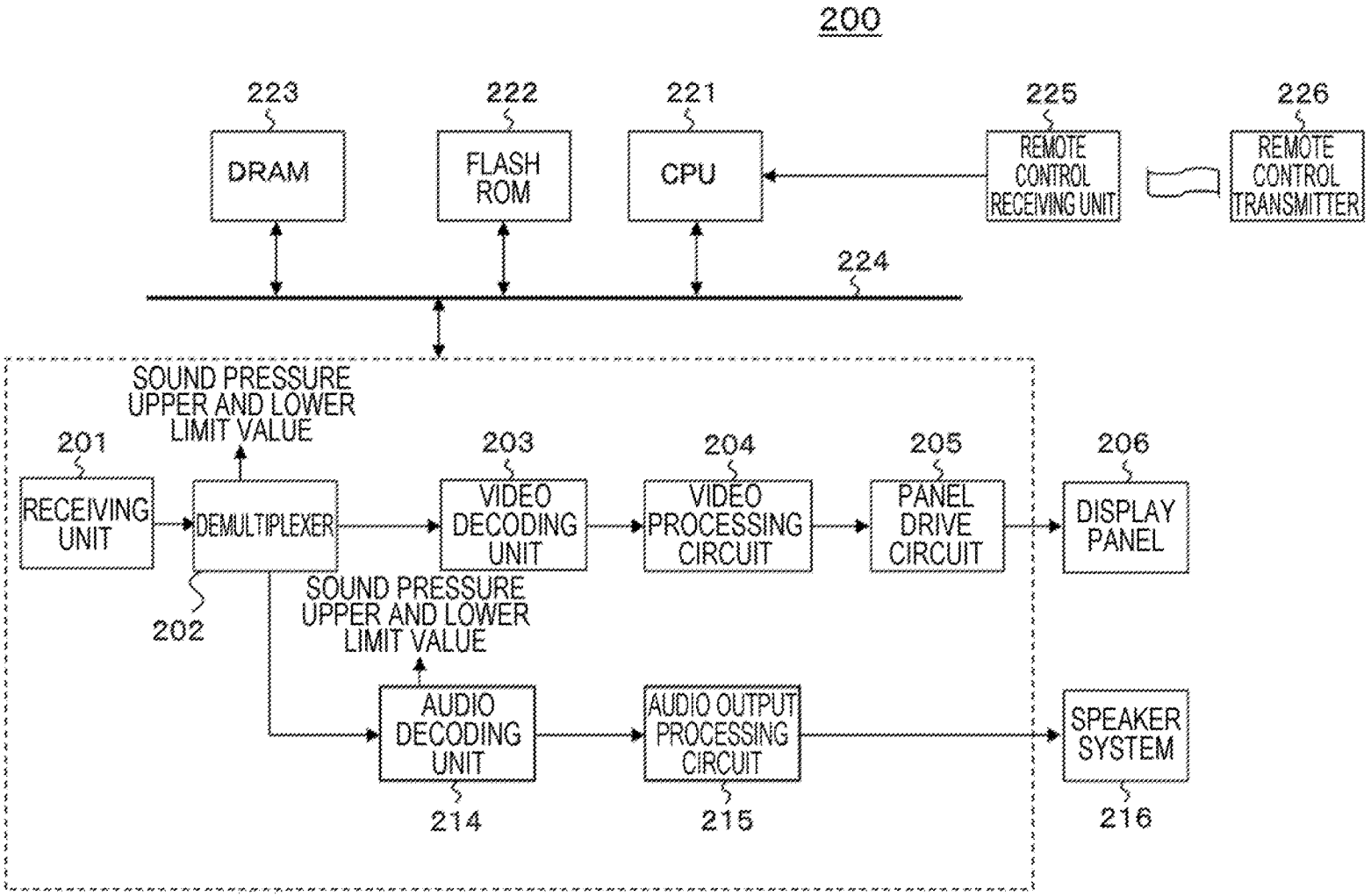
FIG. 11 is a block diagram showing a configuration example of a service receiver.

FIG. 11 shows a configuration example of the service receiver 200. The service receiver 200 includes a receiving unit 201, a demultiplexer 202, a video decoding unit 203, a video processing circuit 204, a panel drive circuit 205 and a display panel 206. In addition, the service receiver 200 includes an audio decoding unit 214, an audio output circuit 215 and a speaker system 216. In addition, the service receiver 200 includes a CPU 221, a flash ROM 222, a DRAM 223, an internal bus 224, a remote control receiving unit 225, and a remote control transmitter 226.

The CPU 221 controls operations of components of the service receiver 200. The flash ROM 222 stores control software and maintains data. The DRAM 223 constitutes a work area of the CPU 221. The CPU 221 deploys the software and data read from the flash ROM 222 in the DRAM 223 to execute the software and controls components of the service receiver 200.

The remote control receiving unit 225 receives a remote control signal (a remote control code) transmitted from the remote control transmitter 226 and supplies the signal to the CPU 221. The CPU 221 controls components of the service receiver 200 based on the remote control code. The CPU 221, the flash ROM 222, and the DRAM 223 are connected to the internal bus 224.

The receiving unit 201 receives broadcast waves or the transport stream TS transmitted through packets via a network from the service transmitter 100. The transport stream TS includes an audio stream in addition to a video stream. The audio stream includes channel coded data of 3D audio transport data and coded data of a predetermined number of pieces of object content (object coded data).

Information indicating a range within which sound pressure is allowed to increase and decrease for a predetermined number of content groups is inserted into a layer of the audio stream and/or a layer of the transport stream TS as a container. One or a plurality of pieces of object content belong to one content group.

Here, a newly defined element (Ext_content_enhancement) including information indicating a range within which sound pressure is allowed to increase and decrease for each content group is inserted into the audio frame as an extension element (Ext_element) (refer to FIG. 3 and FIG. 5). In addition, a newly defined audio content enhancement descriptor (Audio_Content_Enhancement descriptor) including information indicating a range within which sound pressure is allowed to increase and decrease for each content group is inserted into the audio elementary stream loop that is provided under the PMT (refer to FIG. 8).

The demultiplexer 202 extracts a video stream from the transport stream TS and sends the video stream to the video decoding unit 203. The video decoding unit 203 performs decoding processing on the video stream and obtains uncompressed video data.

The video processing circuit 204 performs scaling processing and image quality regulating processing on the video data obtained in the video decoding unit 203 and obtains display video data. The panel drive circuit 205 drives the display panel 206 based on display image data obtained in the video processing circuit 204. The display panel 206 includes, for example, a liquid crystal display (LCD), and an organic electroluminescence (EL) display.

In addition, the demultiplexer 202 extracts various types of information such as descriptor information from the transport stream TS and sends the information to the CPU 221. The various types of information also include an audio content enhancement descriptor including the above-described information indicating a range within which sound pressure is allowed to increase and decrease for each content group. The CPU 221 can recognize a range within which sound pressure is allowed to increase and decrease (an upper limit value and a lower limit value) for each content group according to the descriptor.

In addition, the demultiplexer 202 extracts an audio stream from the transport stream TS and sends the audio stream to the audio decoding unit 214. The audio decoding unit 214 performs decoding processing on the audio stream and obtains audio data for driving each speaker of the speaker system 216.

In this case, in the audio decoding unit 214, only coded data of any one piece of object content according to user selection is set as a decoding target among coded data of a plurality of pieces of object content of a switch group under control of the CPU 221 within coded data of a predetermined number of pieces of object content included in the audio stream.

In addition, the audio decoding unit 214 extracts various types of information that are inserted into the audio stream and transmits the information to the CPU 221. The various types of information also include an element including the above-described information indicating a range within which sound pressure is allowed to increase and decrease for each content group. The CPU 221 can recognize a range within which sound pressure is allowed to increase and decrease (an upper limit value and a lower limit value) for each content group according to the element.

In addition, the audio decoding unit 214 performs a process of increasing and decreasing sound pressure on object content according to user selection under control of the CPU 221. In this case, based on a range within which sound pressure is allowed to increase and decrease (an upper limit value and a lower limit value) for each piece of object content that is inserted into a layer of the audio stream and/or a layer of the transport stream TS as a container, a range of sound pressure increase and decrease is limited. The audio decoding unit 214 will be described below in detail.

The audio output processing circuit 215 performs necessary processing such as D/A conversion and amplification on the audio data for driving each speaker obtained in the audio decoding unit 214 and supplies the result to the speaker system 216. The speaker system 216 includes a plurality of speakers of a plurality of channels, for example, 2 channel, 5.1 channel, 7.1 channel, and 22.2 channel.

[Configuration Example of Audio Decoding Unit]

Figure 12:
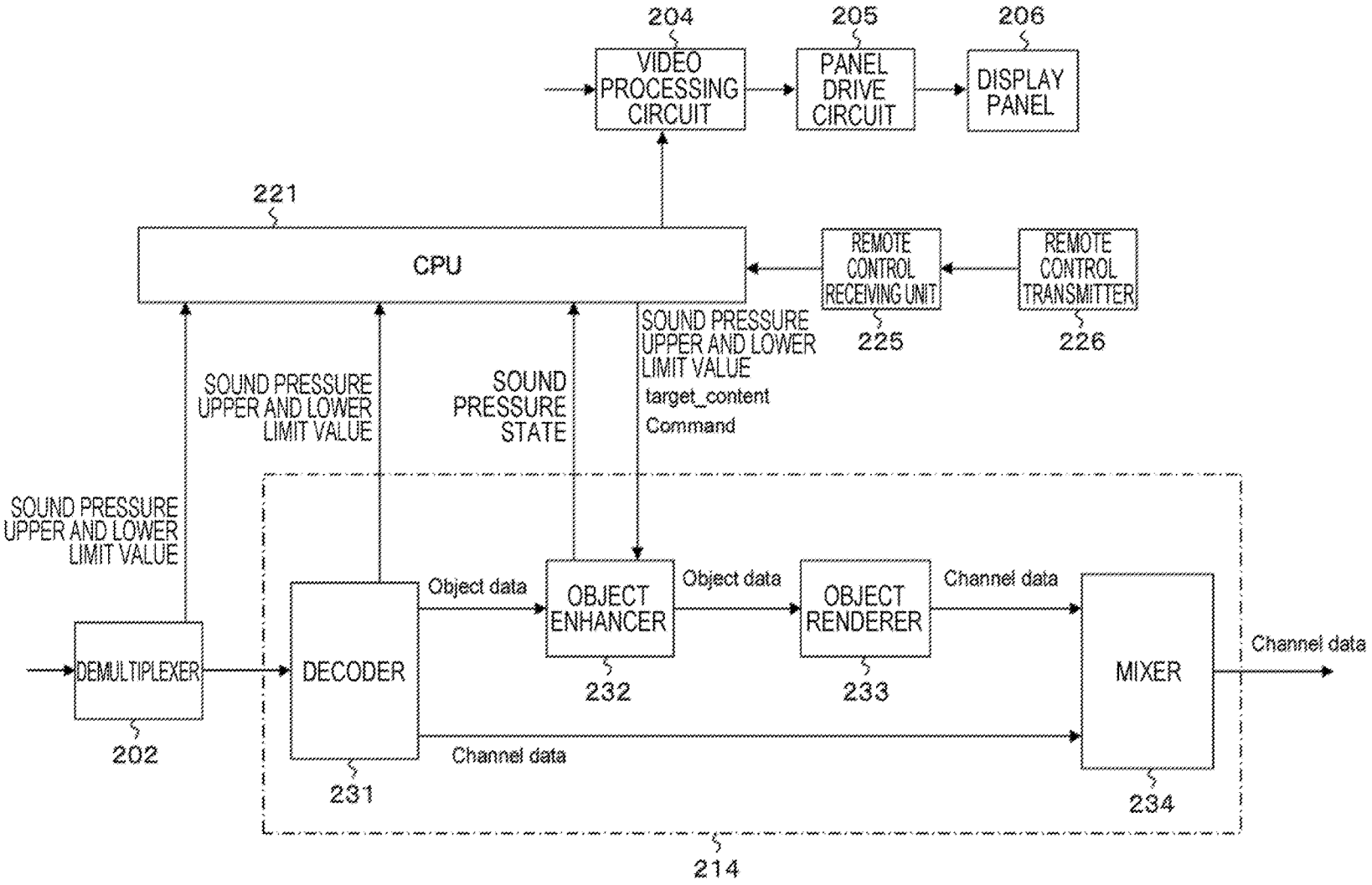
FIG. 12 is a block diagram showing a configuration example of an audio decoding unit.

FIG. 12 shows a configuration example of the audio decoding unit 214. The audio decoding unit 214 includes a decoder 231, an object enhancer 232, an object renderer 233, and a mixer 234.

The decoder 231 performs decoding processing on the audio stream extracted in the demultiplexer 202 and obtains object data of a predetermined number of pieces of object content in addition to the channel data. The decoder 213 performs the processes of the audio encoder 113 of the stream generating unit 110 of FIG. 9 approximately in reverse order. In a plurality of pieces of object content of a switch group, only object data of any one piece of object content according to user selection is obtained under control of the CPU 221

In addition, the decoder 231 extracts various types of information that are inserted into the audio stream and transmits the information to the CPU 221. The various types of information also include an element including the information indicating a range within which sound pressure is allowed to increase and decrease for each content group. The CPU 221 can recognize a range within which sound pressure is allowed to increase and decrease (an upper limit value and a lower limit value) for each content group according to the element.

The object enhancer 232 performs a process of increasing and decreasing sound pressure on object content according to user selection within a predetermined number of pieces of object data obtained in the decoder 231. When the process of increasing and decreasing sound pressure is performed, target content (target_content) indicating object content of a target that will be subjected to the process of increasing and decreasing sound pressure and a command (command) indicating whether to increase or decrease sound pressure are assigned, and a range within which sound pressure is allowed to increase and decrease (an upper limit value and a lower limit value) for the target content is assigned from the CPU 221 to the object enhancer 232 according to a user manipulation.

The object enhancer 232 changes sound pressure of object content of target content (target_content) in a direction (increase or decrease) indicated by the command (command) only by a predetermined width for each unit manipulation of the user. In this case, when the sound pressure is already a limit value that is indicated by an allowable range (an upper limit value and a lower limit value), the sound pressure is not changed and directly used.

In addition, the object enhancer 232 sets a variation width (a predetermined width) of sound pressure with reference to, for example, the table of FIG. 7. For example, when a current state is 1 (0 dB) and a unit manipulation of the user is an increase, the state is changed to a state of 1.4 (+3 dB). In addition, for example, when a current state is 1.4 (+3 dB) and a unit manipulation of the user is an increase, the state is changed to a state of 1.9 (+6 dB).

In addition, for example, when a current state is 1 (0 dB) and a unit manipulation of the user is a decrease, the state is changed to a state of 0.7 (−3 dB). In addition, for example, when a current state is 0.7 (−3 dB) and a unit manipulation of the user is an increase, the state is changed to a state of 0.5 (−6 dB).

In addition, when the process of increasing and decreasing sound pressure is performed, the object enhancer 232 sends information indicating a sound pressure state of each piece of object data to the CPU 221. The CPU 221 displays a user interface screen indicating a current sound pressure state of each piece of object content on a display unit, for example, the display panel 206, based on the information, and provides it when a user sets sound pressure.

Figure 13:
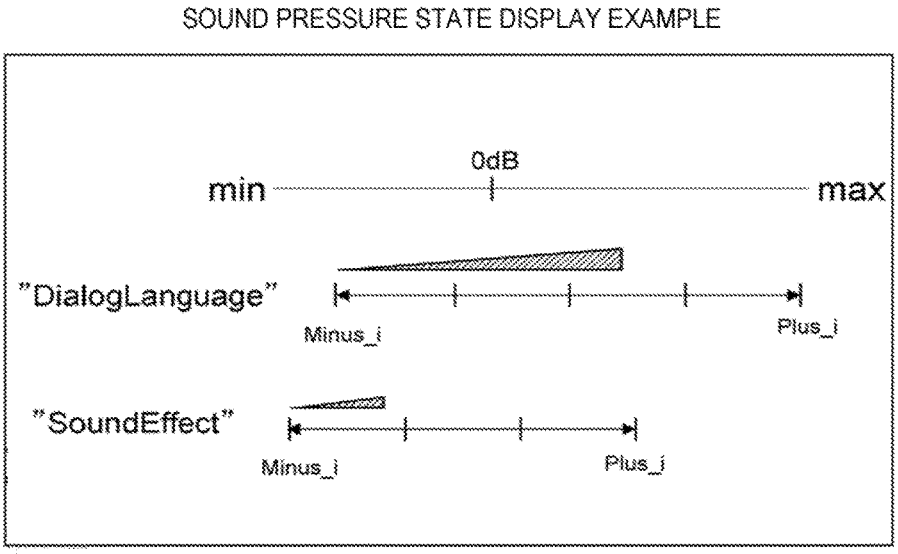
FIG. 13 is a diagram showing an example of a user interface screen showing a current sound pressure state of each piece of object content.

FIG. 13 shows an example of a user interface screen showing a sound pressure state. In this example, a case in which two pieces of object content including a dialog language object (DOD) and a sound effect object (SEO) are provided is shown (refer to FIG. 2). Current sound pressure states are shown at hatched mark portions. "plus_i" indicates an upper limit value and "minus_i" indicates a lower limit value.

Figure 14:
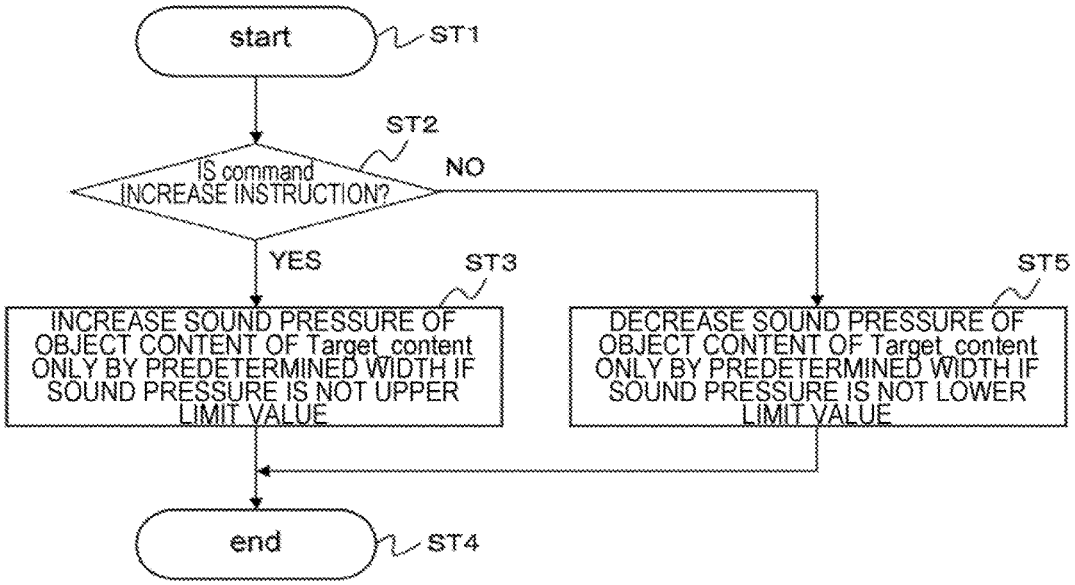
FIG. 14 is a flowchart showing an example of a process of increasing and decreasing sound pressure in an object enhancer according to a unit manipulation of a user.

A flowchart of FIG. 14 shows an example of a process of increasing and decreasing sound pressure in the object enhancer 232 according to a unit manipulation of the user. The object enhancer 232 starts the process in Step ST1. Then, the object enhancer 232 advances to the process of Step ST2.

In Step ST2, the object enhancer 232 determines whether a command (command) is an increase instruction. When an increase instruction is determined, the object enhancer 232 advances to the process of Step ST3. In Step ST3, the object enhancer 232 increases sound pressure of object content of target content (target_content) only by a predetermined width if the sound pressure is not an upper limit value. After the process of Step ST3, the object enhancer 232 ends the process in Step ST4.

In addition, when an increase instruction is not determined in Step ST2, that is, when a decrease instruction is determined, the object enhancer 232 advances to the process of Step ST5. In Step ST5, the object enhancer 232 decreases sound pressure of object content of target content (target_content) only by a predetermined width if the sound pressure is not a lower limit value. After the process of Step ST5, the object enhancer 232 ends the process in Step ST4.

Referring again to FIG. 12, the object renderer 233 performs rendering processing on object data of a predetermined number of pieces of object content obtained through the object enhancer 232 and obtains channel data of a predetermined number of pieces of object content. Here, the object data includes audio data of an object sound source and position information of the object sound source. The object renderer 233 obtains channel data by mapping audio data of an object sound source with any speaker position based on position information of the object sound source.

The mixer 234 combines channel data obtained in the decoder 231 with channel data of each piece of object content obtained in the object renderer 233, and obtains audio data (channel data) for driving each speaker of the speaker system 216.

Operations of the service receiver 200 shown in FIG. 11 will be briefly described. The receiving unit 201 receives the transport stream TS that is sent through broadcast waves or packets via a network from the service transmitter 100. The transport stream TS includes an audio stream in addition to a video stream.

The audio stream includes channel coded data of 3D audio transport data and coded data of a predetermined number of pieces of object content (object coded data). Each of the predetermined number of pieces of object content belongs to any of the predetermined number of content groups. That is, one or a plurality of pieces of object content belong to one content group.

The transport stream TS is supplied to the demultiplexer 202. In the demultiplexer 202, a video stream is extracted from the transport stream TS and supplied to the video decoding unit 203. In the video decoding unit 203, decoding processing is performed on the video stream and uncompressed video data is obtained. The video data is supplied to the video processing circuit 204.

The video processing circuit 204 performs scaling processing and image quality regulating processing on the video data and obtains display video data. The display video data is supplied to the panel drive circuit 205. The panel drive circuit 205 drives the display panel 206 based on the display video data. Accordingly, an image corresponding to the display video data is displayed on the display panel 206.

In addition, the demultiplexer 202 extracts various types of information such as descriptor information from the transport stream TS and sends the information to the CPU 221. The various types of information also include an audio content enhancement descriptor including information indicating a range within which sound pressure is allowed to increase and decrease for each content group. The CPU 221 recognizes a range within which sound pressure is allowed to increase and decrease (an upper limit value and a lower limit value) for each content group according to the descriptor.

In addition, the demultiplexer 202 extracts an audio stream from the transport stream TS and sends the audio stream to the audio decoding unit 214. The audio decoding unit 214 performs decoding processing on the audio stream and obtains audio data for driving each speaker of the speaker system 216.

In this case, in the audio decoding unit 214, only coded data of any one piece of object content according to user selection is set as a decoding target among coded data of a plurality of pieces of object content of a switch group under control of the CPU 221 within coded data of a predetermined number of pieces of object content included in the audio stream.

In addition, the audio decoding unit 214 extracts various types of information that are inserted into the audio stream and transmits the information to the CPU 221. The various types of information also include an element including the above-described information indicating a range within which sound pressure is allowed to increase and decrease for each content group. In the CPU 221, a range within which sound pressure is allowed to increase and decrease (an upper limit value and a lower limit value) for each content group is recognized according to the element.

In addition, in the audio decoding unit 214, a process of increasing and decreasing sound pressure of object content according to user selection is performed under control of the CPU 221. In this case, in the audio decoding unit 214, a range of sound pressure increase and decrease is limited based on a range within which sound pressure is allowed to increase and decrease (an upper limit value and a lower limit value) for each piece of object content.

That is, in this case, target content (target content) indicating object content of a target that will be subjected to the process of increasing and decreasing sound pressure and a command (command) indicating whether to increase or decrease sound pressure are assigned, and a range within which sound pressure is allowed to increase and decrease (an upper limit value and a lower limit value) for the target content is assigned from the CPU 221 to the audio decoding unit 214 according to a user manipulation.

Therefore, in the audio decoding unit 214, sound pressure of object data that belongs to a content group of a target content (target content) is changed in a direction (increase or decrease) indicated by the command (command) only by a predetermined width for each unit manipulation of the user. In this case, when the sound pressure is already a limit value indicated by an allowable range (an upper limit value and a lower limit value), the sound pressure is not changed and directly used.

The audio data for driving each speaker obtained in the audio decoding unit 214 is supplied to the audio output processing circuit 215. The audio output processing circuit 215 performs necessary processing such as D/A conversion and amplification on the audio data. Therefore, the processed audio data is supplied to the speaker system 216. Accordingly, sound corresponding to a display image of the display panel 206 is output from the speaker system 216.

As described above, in the transmitting and receiving system 10 shown in FIG. 1, the service receiver 200 performs a process of increasing and decreasing sound pressure on object content according to user selection. Accordingly, sound pressure of a predetermined number of pieces of object content can be effectively regulated, for example, sound pressure of predetermined object content can increase and sound pressure of another piece of object content can decrease.

Figure 15:
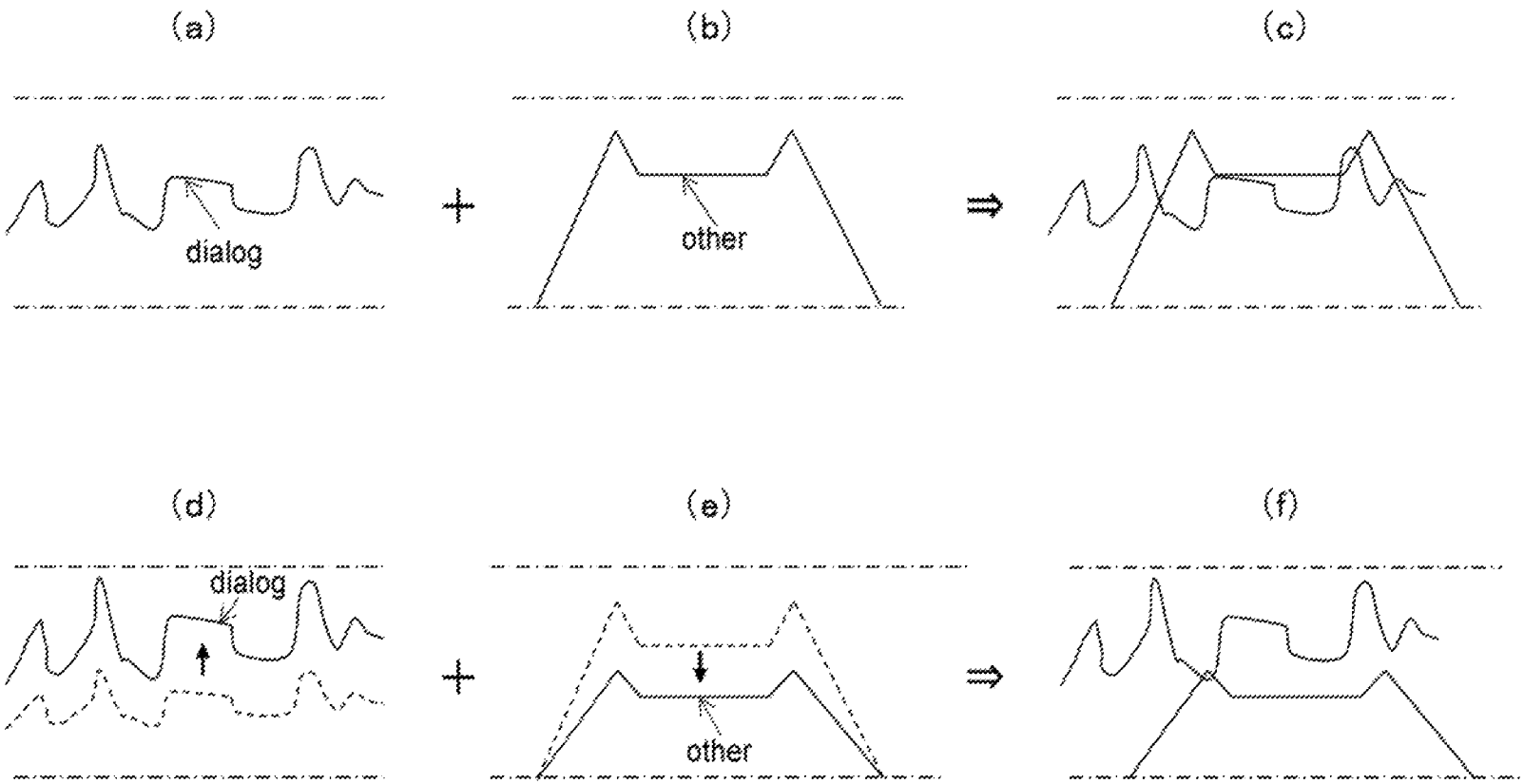
FIG. 15 is a diagram for describing an effect of a sound pressure regulating example of object content.

FIG. 15(*a*) schematically shows a waveform of audio data of object content of a dialog language. FIG. 15(*b*) schematically shows a waveform of audio data of other object content. FIG. 15(*c*) schematically shows waveforms when these pieces of audio data are represented together. In this case, since an amplitude of the waveform of the audio data of the plurality of other pieces of object content is greater than an amplitude of the waveform of the audio data of the dialog language, sound of the dialog language is masked by sound of the other object content and therefore it is very difficult to hear that sound.

FIG. 15(*d*) schematically shows a waveform of audio data of object content of a dialog language whose sound pressure is increased. FIG. 15(*e*) schematically shows a waveform of audio data of other object content whose sound pressure is decreased. FIG. 15(*f*) schematically shows waveforms when these pieces of audio data are represented together.

In this case, since an amplitude of the waveform of the audio data of the dialog language is greater than an amplitude of the waveform of the audio data of the plurality of other pieces of object content, sound of the dialog language is not masked by sound of the other object content and therefore it is easy to hear that sound. In addition, in this case, while sound pressure of the object content of the dialog language increases, since sound pressure of the other object content decreases, constant sound pressure of all of the object content is maintained.

In addition, in the transmitting and receiving system 10 shown in FIG. 1, the service transmitter 100 inserts information indicating a range within which sound pressure is allowed to increase and decrease for each piece of object content into a layer of the audio stream and/or a layer of the transport stream TS as a container. Therefore, when the inserted information is used on a receiving side, it is easy to regulate an increase and decrease of the sound pressure of each piece of object content within the allowable range.

In addition, in the transmitting and receiving system 10 shown in FIG. 1, the service transmitter 100 inserts information indicating a range within which sound pressure is allowed to increase and decrease for each content group to which a predetermined number of pieces of object content belong into a layer of the audio stream and/or a layer of the transport stream TS as a container. Therefore, information indicating a range within which sound pressure is allowed to increase and decrease may be sent to correspond to the number of content groups and it is possible to efficiently transmit the information indicating a range within which sound pressure is allowed to increase and decrease for each piece of object content.

2. Modified Example

In the above-described embodiment, an example in which one factor type is used for information indicating a range within which sound pressure is allowed to increase and decrease for each piece of object content and each content group was shown (refer to FIG. 7). However, it is conceivable that a factor type of information indicating a range within which sound pressure is allowed to increase and decrease for each piece of object content can be selected from among a plurality of types.

FIG. 16 shows an example of a table in which a factor type of information indicating a range within which sound pressure is allowed to increase and decrease for each content group can be selected from among a plurality of types. This example is an example in which two factor types, "factor_1" and "factor_2," are used.

In this case, on a receiving side, in a content group to which "factor_1" is designated, an upper limit value and a lower limit value of sound pressure are recognized with reference to the part of "factor_1" in the table and a variation width by which increase and decrease in sound pressure is regulated is also recognized. In addition, similarly, on a receiving side, in a content group to which "factor_2" is designated, an upper limit value and a lower limit value of sound pressure are recognized with reference to the part of "factor_2" in the table and a variation width by which increase and decrease in sound pressure is regulated is also recognized.

For example, even if "content_enhancement_plus_factor" is the same as "0x02," when "factor_1" is designated, an upper limit value is recognized as 1.9 (+6 dB) and when "factor_2" is designated, an upper limit value is recognized as 3.9 (+12 dB). In addition, when an increase instruction is provided from the state of 1 (0 dB), if "factor_1" is designated, the state is changed to the state of 1.4 (+3 dB), and if "factor_2" is designated, the state is changed to the state of 1.9 (+6 dB). In addition, when the designated value is "0x00" in any factor, both the upper limit value and the lower limit value are 0 dB. This indicates that sound pressure of a target content group is unable to be changed.

FIG. 17 shows a structural example (syntax) of a content enhancement frame (Content_Enhancement_frame( )) when a factor type of information indicating a range within which sound pressure is allowed to increase and decrease for each content group can be selected from among a plurality of types. FIG. 18 shows content (semantics) of main information in the configuration example.

An 8-bit field of "num_of_content_groups" indicates the number of content groups. An 8-bit field of "content_group_id," an 8-bit field of "content_type," an 8-bit field of "factor_type," an 8-bit field of "content_enhancement_plus_factor," and an 8-bit field of "content_enhancement_minus_factor" are repeatedly provided to correspond to the number of content groups.

The field of "content_group_id" indicates an identifier (ID) of the content group. The field of "content_type" indicates a type of the content group. For example, "0" indicates a "dialog language," "1" indicates a "sound effect," "2" indicates "BGM," and "3" indicates "spoken subtitles." The field of "factor_type" indicates an application factor type. For example, "0" indicates "factor_1" and "1" indicates "factor_2."

The field of "content_enhancement_plus_factor" indicates an upper limit value of sound pressure increase and decrease. For example, as shown in the table of FIG. 16, when the application factor type is "factor_1," "0x00" indicates 1 (0 dB), "0x01" indicates 1.4 (+3 dB), and "0xFF" indicates infinite (+infinit dB). When the application factor type is "factor_2," "0x00" indicates 1 (0 dB), "0x01" indicates 1.9 (+6 dB), and "0x7F" indicates infinite (+infinit dB).

The field of "content_enhancement_minus_factor" indicates a lower limit value of sound pressure increase and decrease. For example, as shown in the table of FIG. 16, when an application factor type is "factor_1," "0x00" indicates 1 (0 dB), "0x01" indicates 0.7 (−3 dB), and "0xFF" indicates 0.00 (−infinit dB). When the application factor type is "factor_2," 0x00" indicates 1 (0 dB), "0x01" indicates 0.5 (−6 dB), and "0x7F" indicates 0.00 (−infinit dB).

FIG. 19 shows a structural example (syntax) of an audio content enhancement descriptor (Audio_Content_Enhancement descriptor) when a factor type of information indicating a range within which sound pressure is allowed to increase and decrease for each content group can be selected from among a plurality of types.

An 8-bit field of "descriptor_tag" indicates a descriptor type and indicates an audio content enhancement descriptor here. An 8-bit field of "descriptor_length" indicates a length (a size) of a descriptor and the length of the descriptor indicates the following number of bytes.

An 8-bit field of "num_of_content_groups" indicates the number of content groups. An 8-bit field of "content_group_id," an 8-bit field of "content_type," an 8-bit field of "factor_type," an 8-bit field of "content_enhancement_plus_factor," and an 8-bit field of "content_enhancement_minus_factor" are repeatedly provided to correspond to the number of content groups. Content of information of the fields is similar to that described in the above-described content enhancement frame (refer to FIG. 17).

In addition, in the above-described embodiment, an example in which the service receiver 200 changes sound pressure of object content of target content (target_content) according to user selection in a direction (increase or decrease) indicated by the command (command) only by a predetermined width was described. However, automatically performing a process of increasing and decreasing sound pressure of other object content in a reverse direction when a process of increasing and decreasing sound pressure of object content of target content (target_content) is performed is conceivable.

In this manner, for example, the user can execute the processes of FIGS. 15(*d*) and (*e*) in the service receiver 200 simply by performing an increase manipulation of object content of the dialog language.

Figure 20:
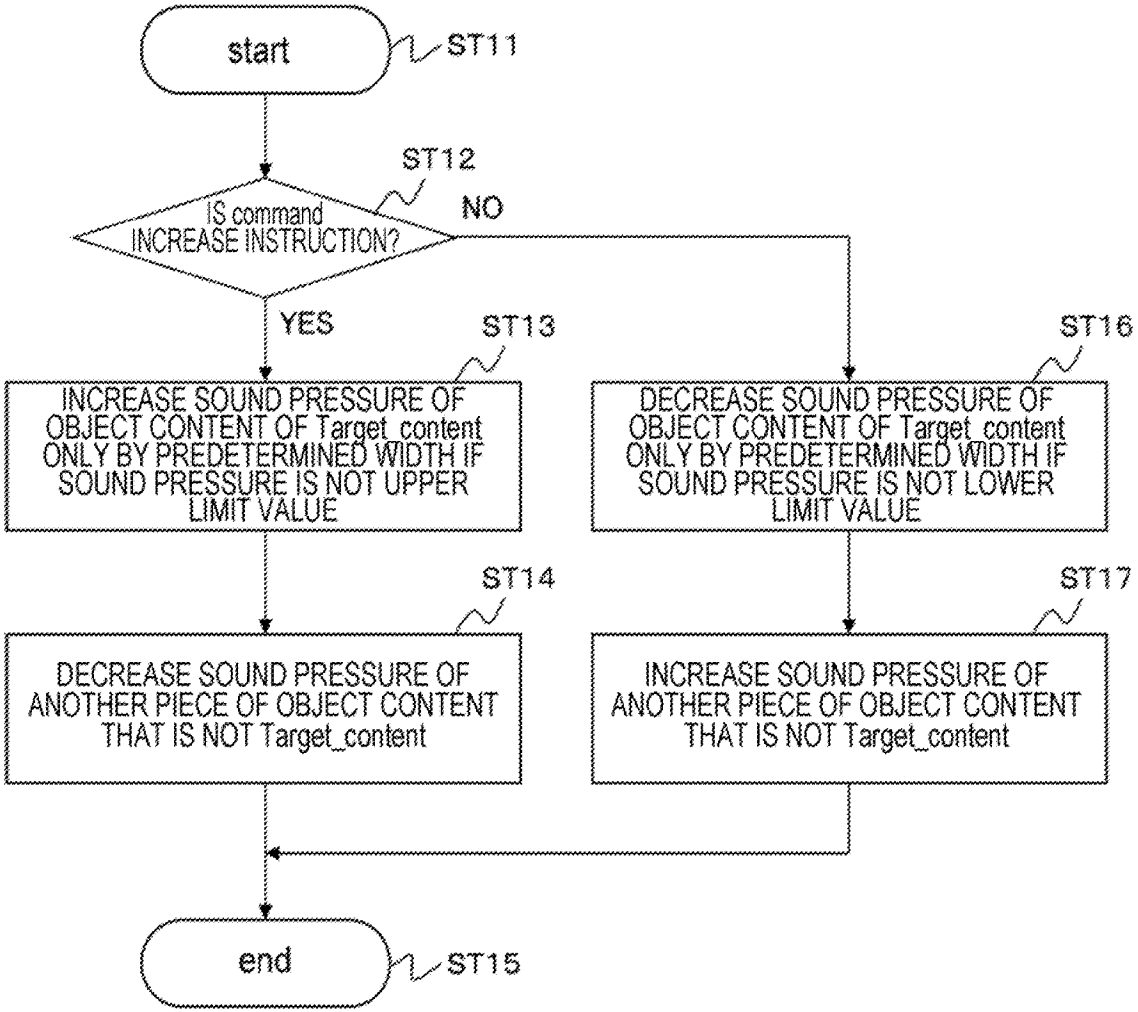
FIG. 20 is a flowchart showing another example of the process of increasing and decreasing sound pressure in an object enhancer according to a unit manipulation of a user.

A flowchart of FIG. 20 shows an example of a process of increasing and decreasing sound pressure in the object enhancer 232 (refer to FIG. 12) according to a unit manipulation of the user in this case. The object enhancer 232 starts the process in Step ST11. Then, the object enhancer 232 advances to the process of Step ST12.

In Step ST12, the object enhancer 232 determines whether a command (command) is an increase instruction. When an increase instruction is determined, the object enhancer 232 advances to the process of Step ST13. In Step ST13, the object enhancer 232 increases sound pressure of object content of target content (target content) only by a predetermined width if the sound pressure is not an upper limit value.

Next, in Step ST14, in order to maintain constant sound pressure of all of the object content, the object enhancer 232 decreases sound pressure of another piece of object content that is not target content (target_content). In this case, the sound pressure is decreased in accordance with an increase of the above-described sound pressure of the object content of target content (target_content) In this case, one or a plurality of other pieces of object content are related to a sound pressure decrease. After the process of Step ST14, the object enhancer 232 ends the process in Step ST15.

In addition, in Step ST12, when an increase instruction is not determined, that is, a decrease instruction is determined, the object enhancer 232 advances to the process of Step ST16. In Step ST16, the object enhancer 232 decreases sound pressure of object content of target content (target_content) only by a predetermined width if the sound pressure is not a lower limit value.

Next, in Step ST17, in order to maintain constant sound pressure of all of the object content, the object enhancer 232 increases sound pressure of another piece of content that is not target content (target_content). In this case, the sound pressure is decreased in accordance with an increase of the sound pressure of object content of the above-described target content (target_content). In this case, one or a plurality of other pieces of object content are related to a sound pressure decrease. After the process of Step ST17, the object enhancer 232 ends the process in Step ST15.

In the above-described embodiment, an example in which information indicating a range within which sound pressure is allowed to increase and decrease for each content group was inserted into both a layer of the audio stream and a layer of the transport stream TS as a container was shown. However, it is conceivable that the information is inserted into only a layer of the audio stream or a layer of the transport stream TS as a container.

In addition, in the above-described embodiment, an example in which the container was the transport stream (MPEG-2 TS) was shown. However, the present technology can be similarly applied to a system that is delivered through a container of MP4 or other formats. For example, a stream delivery system based on MPEG-DASH or a transmitting and receiving system handling an MPEG media transport (MMT) structural transport stream may be used.

Figure 21:
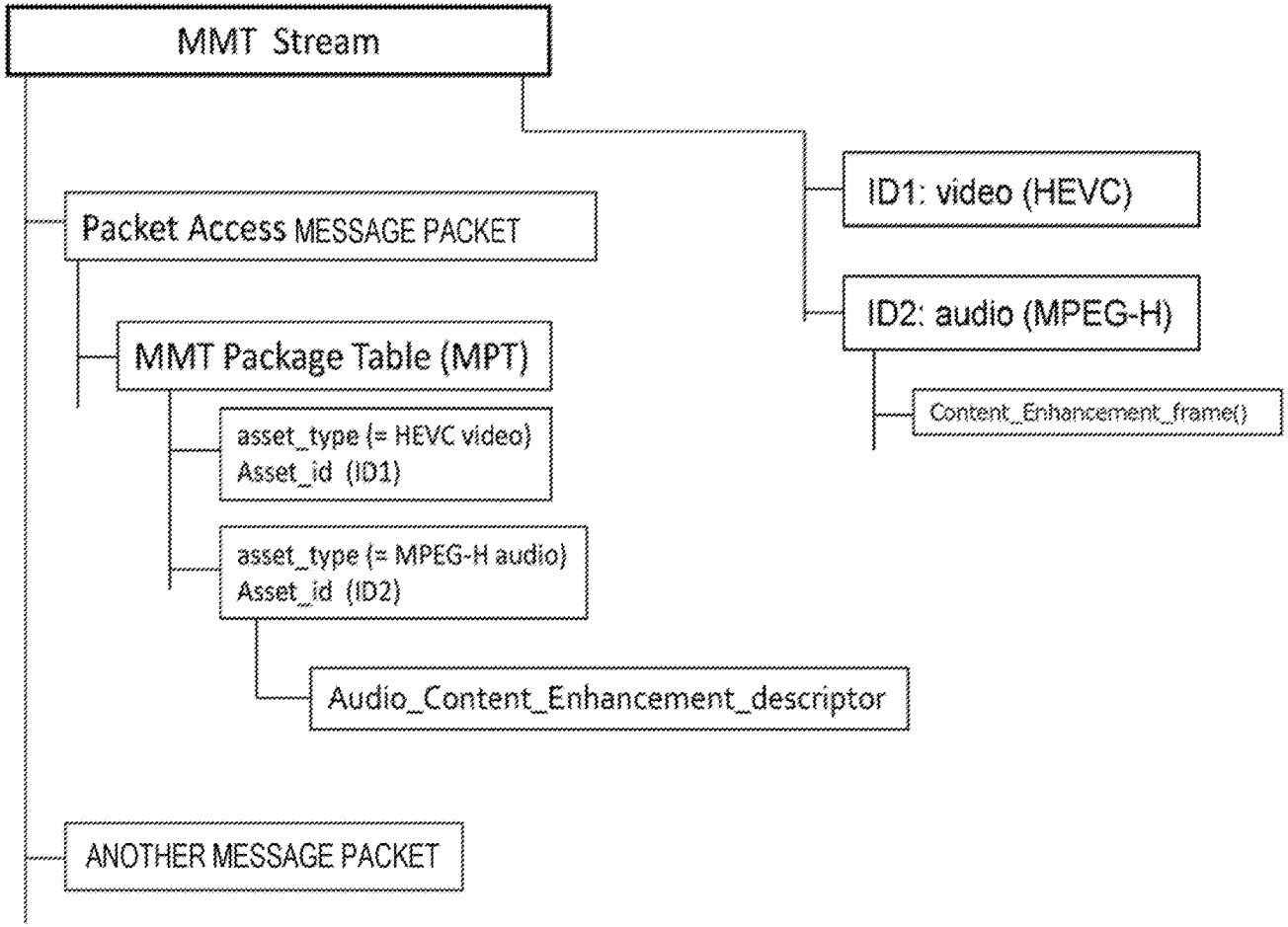
FIG. 21 is a diagram showing a structural example of an MMT stream.

FIG. 21 shows a structural example of an MMT stream. The MMT stream includes MMT packets of assets such as a video and an audio. The structural example includes an MMT packet of an asset of a video that is identified as an ID1 and an MMT packet of an asset of audio that is identified as an ID2.

A content enhancement frame (Content_Enhancement_frame( )) including information indicating a range within which sound pressure is allowed to increase and decrease for each content group is inserted into an audio frame of the asset (audio stream) of the audio.

In addition, the MMT stream includes a message packet such as a Packet Access (PA) message packet. The PA message packet includes a table such as an MMT•packet•table (MMT Package Table). The MP table includes information for each asset. An audio content enhancement descriptor (Audio_Content_Enhancement descriptor) including information indicating a range within which sound pressure is allowed to increase and decrease for each content group is assigned according to the asset (audio stream) of the audio.

Additionally, the present technology may also be configured as below.

(1)

A transmitting device including:

an audio encoding unit configured to generate an audio stream including coded data of a predetermined number of pieces of object content;

a transmitting unit configured to transmit a container of a predetermined format including the audio stream; and an information inserting unit configured to insert information indicating a range within which sound pressure is allowed to increase and decrease for each piece of object content into a layer of the audio stream and/or a layer of the container.

(2)

The transmitting device according to (1), wherein each of the predetermined number of pieces of object content belongs to any of a predetermined number of content groups, and the information inserting unit inserts information indicating a range within which sound pressure is allowed to increase and decrease for each content group into a layer of the audio stream and/or a layer of the container.

(3)

The transmitting device according to (1) or (2), wherein the audio stream has a coding scheme that is MPEG-H 3D Audio, and the information inserting unit includes an extension element including the information indicating a range within which sound pressure is allowed to increase and decrease for each piece of object content in an audio frame.

(4)

The transmitting device according to any of (1) to (3), wherein factor selection information indicating a type to be applied among a plurality of factors is added to the information indicating a range within which sound pressure is allowed to increase and decrease for each piece of object content.

(5)

A transmitting method including:

an audio encoding step of generating an audio stream including coded data of a predetermined number of pieces of object content;

a transmitting step of transmitting, by a transmitting unit, a container of a predetermined format including the audio stream; and an information inserting step of inserting information indicating a range within which sound pressure is allowed to increase and decrease for each piece of object content into a layer of the audio stream and/or a layer of the container.

(6)

A receiving device including:

a receiving unit configured to receive a container of a predetermined format including an audio stream including coded data of a predetermined number of pieces of object content; and a processing unit configured to perform a process of increasing and decreasing sound pressure in which sound pressure of object content increases and decreases according to user selection.

(7)

The receiving device according to (6), wherein information indicating a range within which sound pressure is allowed to increase and decrease for each piece of object content is inserted into a layer of the audio stream and/or a layer of the container, the receiving device further includes an information extraction unit configured to extract the information indicating a range within which sound pressure is allowed to increase and decrease for each piece of object content from the layer of the audio stream and/or the layer of the container, and the processor unit increases and decreases sound pressure of object content according to user selection based on the extracted information.

(8)

The receiving device according to (6) or (7), wherein the processing unit decreases, when sound pressure of the object content increases according to the user selection, sound pressure of another piece of object content, and increases, when sound pressure of the object content decreases according to the user selection, sound pressure of another piece of object content.

(9)

The receiving device according to any of (6) to (8), further including:

a display control unit configured to display a UI screen indicating a sound pressure state of object content whose sound pressure is increased and decreased by the processing unit.

(10)

A receiving method including:

a receiving step of receiving, by a receiving unit, a container of a predetermined format including an audio stream including coded data of a predetermined number of pieces of object content; and a processing step of increasing and decreasing sound pressure in which sound pressure of object content increases and decreases according to user selection.

A main feature of the present technology is that information indicating a range within which sound pressure is allowed to increase and decrease for each piece of object content is inserted into a layer of the audio stream and/or a layer of the container and an increase and decrease of sound pressure of each piece of object content is appropriately regulated within an allowable range on a receiving side (refer to FIG. 9 and FIG. 10).

REFERENCE SIGNS LIST

10 transmitting and receiving system
100 service transmitter
110 stream generating unit
111 control unit
112 video encoder
113 audio encoder
114 multiplexer
200 service receiver
201 receiving unit
202 demultiplexer
203 video decoding unit
204 video processing circuit
205 panel drive circuit
206 display panel
214 audio decoding unit
215 audio output processing circuit
216 speaker system
221 CPU
222 flash ROM
223 DRAM
224 internal bus
225 remote control receiving unit
226 remote control transmitter
231 decoder
232 object enhancer
233 object renderer
234 mixer

The invention claimed is:

1. A device comprising:

a transmitter configured to transmit a container of a predetermined format including an audio stream; and processing circuitry configured to generate the audio stream including coded data of a predetermined number of pieces of object content, each of the predetermined number of pieces of object content belongs to any of a predetermined number of content groups, the predetermined number of content groups including a dialog language, a sound effect, and spoken subtitles, and insert information indicating a range within which sound pressure is allowed to increase and decrease for each of the predetermined number of content groups into a layer of the audio stream and/or a layer of the container, wherein the information includes a factor type and enhancement factors, the range being determined based on the factor type and the enhancement factors,.

the sound pressure of first object content of the pieces of object content is increased when the sound pressure is not at an upper limit value and when a command is an increase instruction;

the sound pressure of second object content of the pieces of object content is decreased when the command is the increase instruction;

the sound pressure of the first object content is decreased when the sound pressure is not at a lower limit value and when the command is not the increase instruction; and the sound pressure of the second object content is increased when the command is not the increase instruction.

2. The device according to claim 1, wherein the audio stream has a coding scheme that is MPEG-H 3D Audio, and wherein the processing circuitry is further configured to include the information indicating a range within which the sound pressure is allowed to increase and decrease for each of the predetermined number of pieces of object content in an audio frame.

3. The device according to claim 1, wherein the factor type indicates a type to be applied among a plurality of factor types added to the information indicating a range within which the sound pressure is allowed to increase and decrease for each of the predetermined number of pieces of object content.

4. The device according to claim 1, wherein the information includes a minimum enhancement factor and a maximum enhancement factor, the minimum and maximum enhancement factors being the function of the factor type and a content group of the predetermined number of content groups.

5. A method comprising:

generating, using processing circuitry, an audio stream including coded data of a predetermined number of pieces of object content, each of the predetermined number of pieces of object content belongs to any of a predetermined number of content groups, the predetermined number of content groups including a dialog language, a sound effect, and spoken subtitles;

transmitting, by a transmitter, a container of a predetermined format including the audio stream; and inserting information indicating a range within which sound pressure is allowed to increase and decrease for each of the predetermined number of content groups into a layer of the audio stream and/or a layer of the container, wherein the information includes a factor type and enhancement factors, the range being determined based on the factor type and the enhancement factors, the sound pressure of first object content of the pieces of object content is increased when the sound pressure is not at an upper limit value and when a command is an increase instruction;

the sound pressure of second object content of the pieces of object content is decreased when the command is the increase instruction;

the sound pressure of the first object content is decreased when the sound pressure is not at a lower limit value and when the command is not the increase instruction; and the sound pressure of the second object content is increased when the command is not the increase instruction.

6. A device comprising:

a receiver configured to receive a container of a predetermined format including an audio stream including coded data of a predetermined number of pieces of object content, each of the predetermined number of pieces of object content belongs to any of a predetermined number of content groups, the predetermined number of content groups including a dialog language, a sound effect, and spoken subtitles; and processing circuitry configured to control a process of increasing and decreasing sound pressure in which sound pressure of object content increases and decreases according to user selection based on information received in the container indicating a range for each of the predetermined number of content groups, wherein the information includes a factor type and enhancement factors, the range being determined based on the factor type and the enhancement factors, and the processing circuitry configured to increase the sound pressure of first object content of the pieces of object content when the sound pressure is not at an upper limit value and when a command is an increase instruction;

decrease the sound pressure of second object content of the pieces of object content when the command is the increase instruction;

decrease the sound pressure of the first object content when the sound pressure is not at a lower limit value and when the command is not the increase instruction; and increase the sound pressure of the second piece of object content when the command is not the increase instruction.

7. The device according to claim 6, wherein information indicating a range within which the sound pressure is allowed to increase and decrease for each of the predetermined pieces of object content is inserted into a layer of the audio stream and/or a layer of the container, and the processing circuitry is further configured to extract the information indicating the range within which the sound pressure is allowed to increase and decrease for each of the predetermined pieces of object content from the layer of the audio stream and/or the layer of the container.

8. The device according to claim 6, wherein the processing circuity is further configured to control a display in which a user interface screen indicating a sound pressure state of the object content for which sound pressure increases and decreases in the process of increasing and decreasing sound pressure is displayed.

9. The device according to claim 8, wherein the processing circuitry is further configured to:

display a user interface that includes a minimum sound pressure and a maximum sound pressure for at least two of the content groups.

10. A method comprising:

receiving, by a receiver, a container of a predetermined format including an audio stream including coded data of a predetermined number of pieces of object content each of the predetermined number of pieces of object content belongs to any of a predetermined number of content groups, the predetermined number of content groups including a dialog language, a sound effect, and spoken subtitles; and increasing and decreasing sound pressure in which sound pressure of object content increases and decreases according to user selection based on information received in the container indicating a range for each of the predetermined number of content groups, wherein the information includes a factor type and enhancement factors, the range being determined based on the factor type and the enhancement factors, and the increasing and decreasing the sound pressure includes increasing the sound pressure of first object content of the pieces of object content when the sound pressure is not at an upper limit value and when a command is an increase instruction;

decreasing the sound pressure of second object content of the pieces of object content when the command is the increase instruction;

decreasing the sound pressure of the first object content when the sound pressure is not at a lower limit value and when the command is not the increase instruction; and increasing the sound pressure of the second object content when the command is not the increase instruction.

* * * * *